United States Patent [19]

Wiegner

[11] 4,247,001

[45] Jan. 27, 1981

[54] SEALED CONTAINER WITH FRANGIBLE PARTITION

[76] Inventor: Georg Wiegner, Breslauer Strasse 35, 4060 Viersen 11, Fed. Rep. of Germany

[21] Appl. No.: 910,864

[22] Filed: May 30, 1978

Related U.S. Application Data

[63] Continuation-in-part of Ser. No. 720,154, Sep. 3, 1976, Pat. No. 4,103,772.

[30] Foreign Application Priority Data

May 31, 1977 [DE] Fed. Rep. of Germany ..... 2724519

[51] Int. Cl.[3] ..... B65D 23/04

[52] U.S. Cl. ..... 206/222; 215/DIG. 8

[58] Field of Search ..... 128/272.1; 206/219-222, 568; 215/6, 227, DIG. 8; 366/602

[56] References Cited

U.S. PATENT DOCUMENTS

| | | | |
|---|---|---|---|
| 2,661,742 | 12/1953 | Haudroy | 215/DIG. 8 |
| 3,156,369 | 12/1979 | Bowes et al. | 206/222 |
| 3,521,745 | 7/1970 | Schwartzman | 206/222 |
| 3,537,577 | 11/1970 | Goupil | 206/222 |
| 3,548,562 | 12/1970 | Schwartzman | 206/222 X |

FOREIGN PATENT DOCUMENTS

| | | | |
|---|---|---|---|
| 2637675 | 8/1976 | Fed. Rep. of Germany | 206/222 |
| 7512070 | 5/1976 | Netherlands | 206/222 |

*Primary Examiner*—Ste phen Marcus

*Attorney, Agent, or Firm*—Toren, McGeady and Stanger

[57] ABSTRACT

A container whose shell consists of two cup-shaped parts bounding respective compartments of the shell cavity separated from each other by a frangible membrane. A piercing assembly in the compartment of one part includes a blade member extending in a closed loop contiguously adjacent the circumferential wall of the one part and spacers interposed between the blade member and the bottom wall which is resiliently movable inward of the shell cavity for engagement with the spacers whereupon the blade member cuts the membrane.

3 Claims, 5 Drawing Figures

SEALED CONTAINER WITH FRANGIBLE PARTITION

This application is a continuation-in-part of my copending application Ser. No. 720,154 filed Sept. 3, 1976, now U.S. Pat. No. 4,103,772.

In my earlier application, I disclosed a container whose cavity is divided into two compartments by a frangible membrane. One of the end walls of the container may be moved resiliently toward the membrane and carries one or two piercing members which punch holes in the membrane when the end wall is moved inward of the cavity, thereby permitting the contents of the two compartments to be mixed while still sealed from the ambient atmosphere.

While the container of my earlier application has been used successfully in many instances, the holes punched in the membrane by the piercing members are not large enough for rapid mixing of viscous liquids contained in the two compartments.

The primary object of this invention is the provision of an improved container of the type described which permits even very viscous, liquids respectively stored in the two compartments to be mixed quickly.

With this object and others in view, as will presently become apparent, the invention provides a shell defining a cavity therein and including two cup-shaped parts. Each part has a bottom wall and an annular circumferential wall extending away from the bottom wall toward an opening of the part spacedly opposite the bottom wall. The parts are fastened to each other in a position in which the bottom walls are spaced from each other, and the circumferential wall of each part extends from the bottom wall of the part in a direction toward the bottom wall of the other part.

A frangible membrane transverse to the afore-mentioned direction divides the shell cavity into two compartments respectively bounded by the two cup-shaped parts, and the bottom wall of one part is resiliently movable inward of the cavity toward the membrane. A piercing assembly in the compartment of the one part includes a blade member elongated transversely of the afore-mentioned direction contiguously adjacent the circumferential wall of the one part, and spacers are interposed between the blade member and the associated bottom wall for movement with the bottom wall and cutting of the membrane by the blade member when the bottom wall moves resiliently inward of the compartment.

It is preferred that the blade member be elongated in a substantially closed loop extending along a plane transverse to the afore-mentioned direction and defining an area in the plane greater than one half of the cross-sectional area of the shell cavity in that plane.

Other features, additional objects, and many of the attendant advantages of this invention will readily be appreciated as the same becomes better understood from the following detailed description of presently preferred embodiments when considered in connection with the appended drawing in which.

Figure 1:
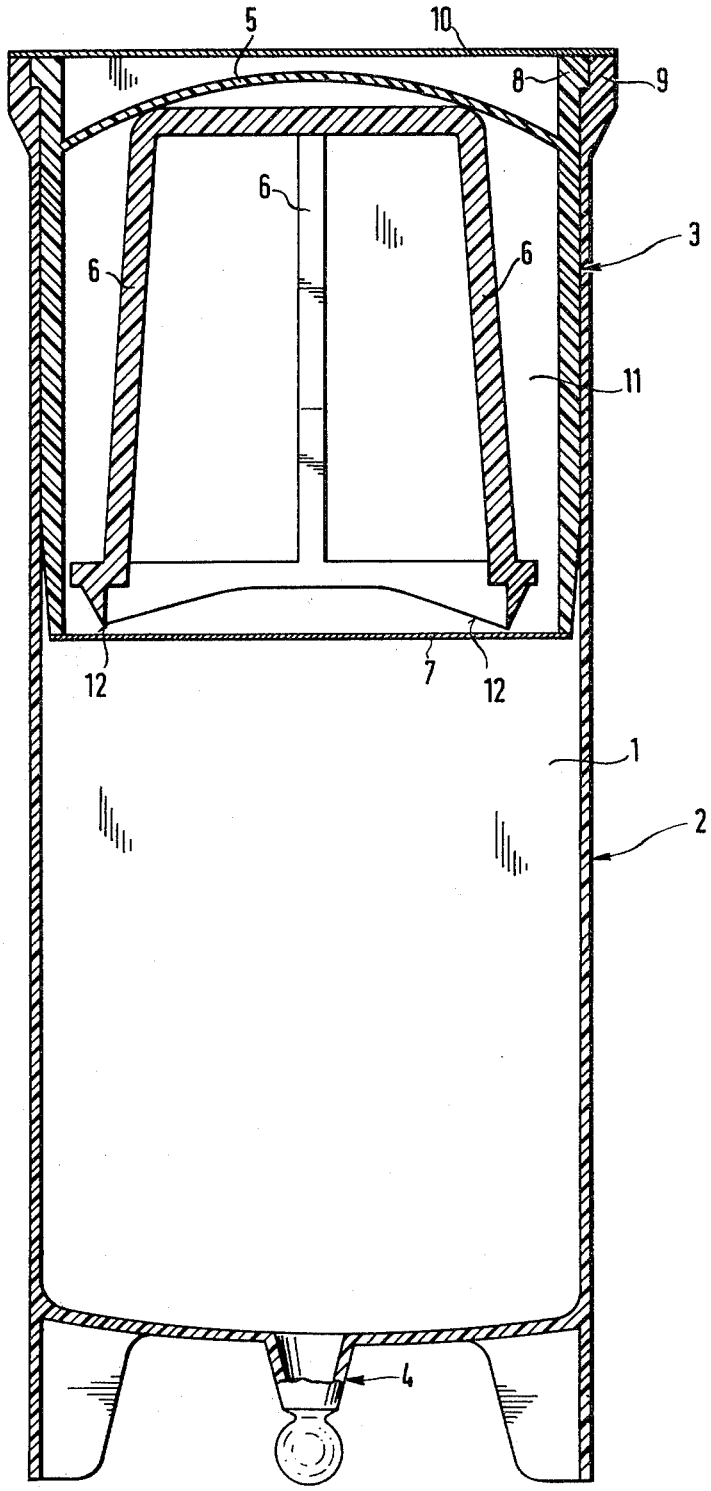
FIG. 1 shows a container of this invention in elevational section.
Figure 3:
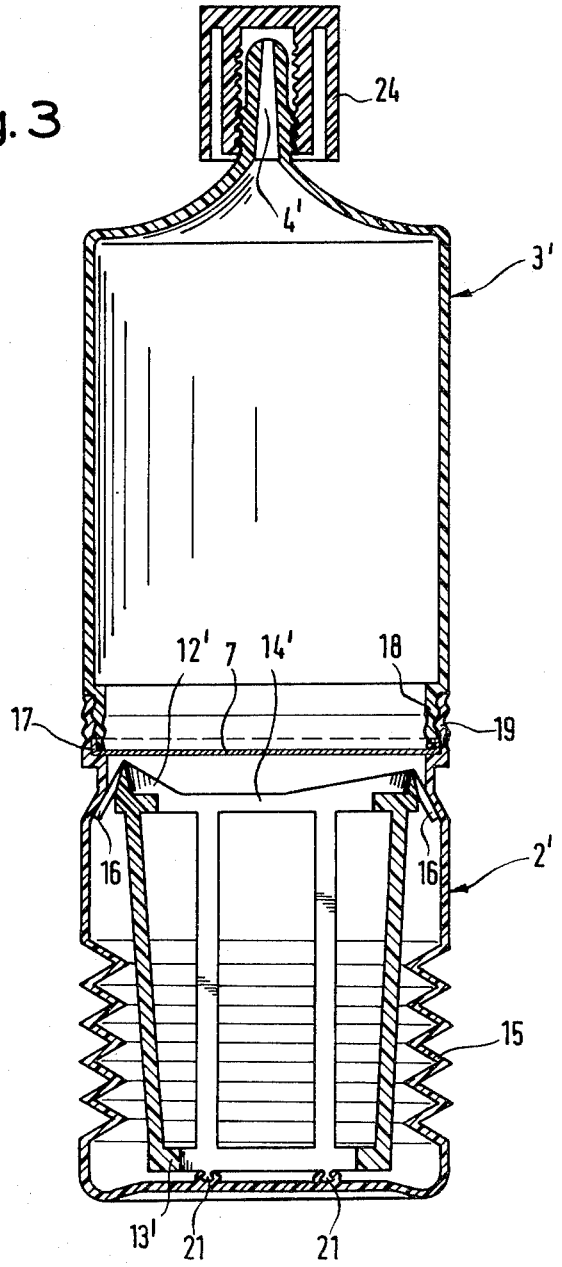
Figure 4:
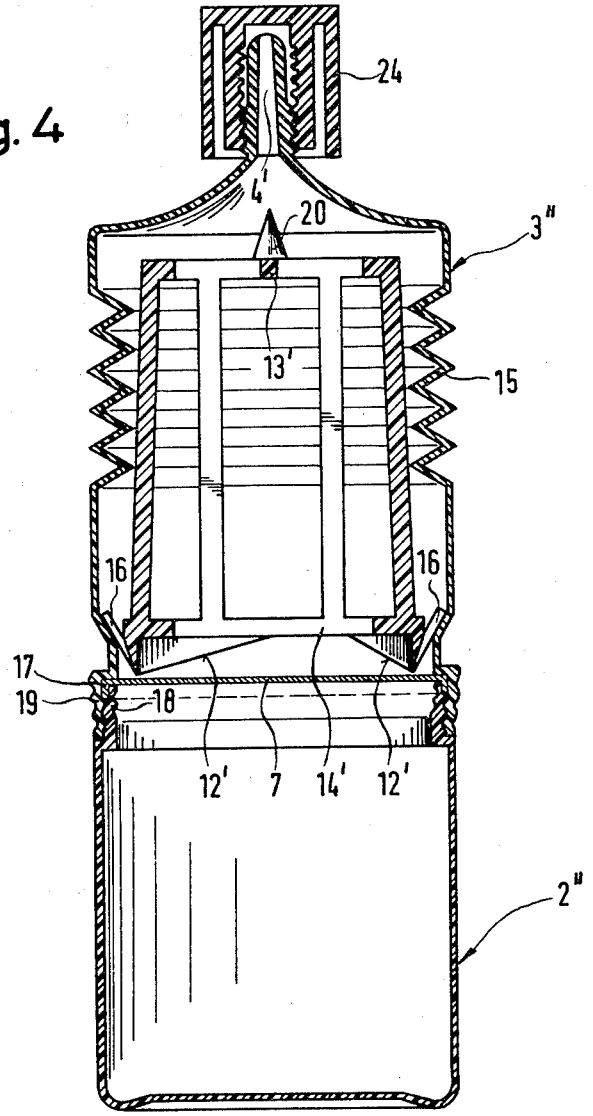

FIG. *2a* shows the piercing assembly in the container of FIG. 1 in a perspective view; and FIGS. 3 and 4 are elevationally sectional views of additional containers of the invention.

Referring now to the drawing in detail, and initially to FIG. 1, there is shown a container whose cavity consists of two compartments 1, 11 respectively bounded by two unitary shell parts 2, 3 of somewhat resilient plastic, each of which has the approximate overall shape of a quadrangular, prismatic cup. The bottom wall of the larger part 2 is formed with a normally sealed discharge spout 4. The smaller part 3 is received in the larger part in an upside-down position so that the bottom walls of the two parts are separated by almost the entire length of the container, the annular, circumferential wall of each part extending from the associated bottom wall toward the bottom wall of the other part. A flange 8 on a portion of the circumferential wall of the smaller shell part 3 projects beyond the associated bottom wall 5 and is heat-sealed to a conforming flange 9 on the rim about the opening of the larger part 2.

A membrane 7 of plastic-coated aluminum foil is heat sealed to the rim of the smaller shell part 3 about the opening of the latter and thereby seals the two compartments from each other. Another similar aluminum foil 10 is heat-sealed to the flanges 8, 9 and protects the convex outer face of the bottom wall 5. The bottom wall 5 is resilient enough that it may be moved inward of the compartment 11 by the pressure of a finger after the foil 10 is broken. The structure described so far is known from my earlier application.

A piercing assembly is confined in the compartment 11 between the bottom wall 5 and the membrane 7. As better shown in FIG. 2a in an inverted position, it includes a smaller, rectangular top frame 13 and a larger, rectangular bottom or blade frame 14. Spacer bars 6 of rectangular cross section and having sharp-edged longitudinal faces connect the center of each side of the frame 13 to the center of the corresponding side of the blade frame 14. The top frame 13 is provided with two cross bars rectangularly intersecting each other and connecting the top longitudinal ends of the spacer bars 6. The bottom frame carries a sharp-edged cutting blade 12 which extends over three sides of the closed loop constituted by the frame 14 and approximately two thirds of the fourth side, which is one of the two long sides of the frame. The height of the blade 12 varies along its length.

The several elements of the piercing assembly are integral portions of a unitary body of plastic hard enough for the cutting edge 12 to pierce the membrane 7 along a cutting line contiguously adjacent the circumferential wall of the part 3 when the bottom wall 5 is moved inward of the compartment 11. The dull frame portion between the longitudinal ends of the cutting edge 12 engages the membrane 7 after the cutting action is completed and assists in bending a flap out of the original plane of the membrane 7. As is evident from FIG. 1, the area defined by the cutting edge 12 in the plane of the membrane 7 is much greater than one half of the cross section of the shell cavity in the same plane. The flap removed from the large opening in the membrane 7 remains attached to the shell part 3 by an integral hinge portion. It cannot descend to obstruct the discharge spout 4 when the mixed contents of the container are to be withdrawn through the spout.

In a typical container of the type shown in FIG. 1, the bottom wall 5 has a radius of curvature of approximately 80 mm and a thickness of about 0.5 mm. The membrane 7 is pierced when a finger depresses the bottom wall 5 about 10–20 mm. Other dimensions of the illustrated container will be apparent from the fact that the dull gap in the knife edge 12 has a length of about 15 mm.

After cutting of the membrane 7 by the knife edge 12, the contents of the compartments 1, 11 are readily mixed by shaking the container. They may be withdrawn after the spout 4 is partly cut off, and discharge may be hastened by pressing the bottom wall 5. The several spacer bars 6 are sufficiently flexible to deform under the pressure manually applied to the bottom wall 5 against the resistance of the viscous fluid in the container so that the sharp edges of the bars 6 stir the mixture in the container.

The container illustrated in FIG. 3 has a shell consisting of two parts 2', 3' which have the approximate shape of cups of elliptic cross section. The circumferential wall 15 of the part 2' is pleated in the manner of bellows of an accordion to facilitate movement of the bottom wall of the part 2' together with a piercing assembly attached to integral clips 21 on the bottom wall toward a membrane 7 which seals the opening of the part 2'. A tubular extension 19 of the wall 15 projects upward beyond the membrane 7 and receives therein the tubular rim 18 of the shell part 3'. A tubular portion 17 of the foil 7 is received between the extension 19 and the rim 18, and the two container parts 2', 3' and the foil 7 are fixedly fastened to each other by a welded jointing connecting the extension 19 and the rim 18 to the plastic-coated foil 17. The shell part 3' carries a tubular discharge spout 4'whose permanently open outer end is sealed by a screw cap 24.

Figure 2:
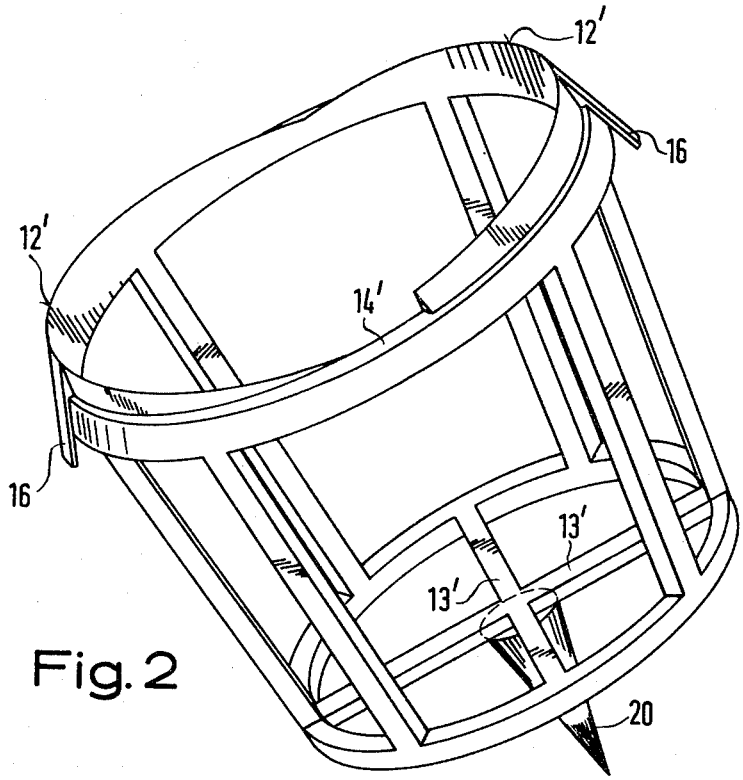
FIG. 2 illustrates a piercing assembly in the container of FIG. 4 in a perspective view.
Figure 2A:
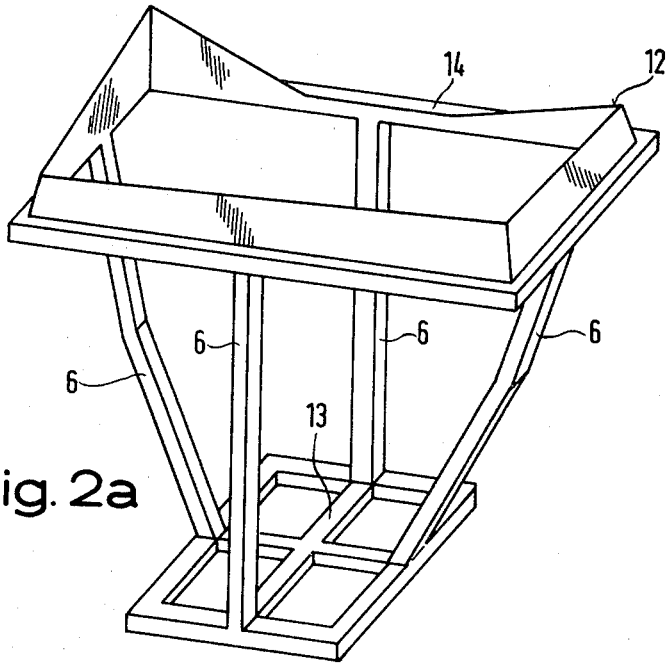

The piercing assembly of the container shown in FIG. 3 has not been illustrated specifically, but it is closely similar to that shown in FIG. 2 in that it has a larger, elliptic frame 14' carrying a knife edge 12' over more than 90% of its circumference and connected to a smaller, elliptic frame 13' by spacer bars 6. Cross bars of the frame 13' are attached to the clips 21. Guide lugs 16 laterally projecting from the frame 14' engage the circumferential wall 15 to steady the piercing assembly and to guide the assembly into proper cutting engagement with the foil 7.

The operation of the container of FIG. 3 will be obvious from the description of that illustrated in FIG. 1.

FIG. 4 shows yet another container of the invention in which certain elements of the device of FIG. 3 have been interchanged. The shell part 2" has a smooth circumferential wall of elliptic cross section carrying an extension 19 in which the rim 18 of the other shell part 3" and a tubular portion 17 of a foil 7 are received and heat sealed as described with reference to FIG. 3. The shell part 3" has a pleated circumferential wall 15 which bounds a compartment receiving the piercing assembly illustrated in FIG. 2. The bottom wall of the shell part 3" is equipped with a spout 4' releasably sealed by a screw cup 24.

The piercing assembly is laterally guided in the shell part 3" by guide lugs 16 and by the pleats in the circumferential wall 15, but it is only loosely confined between the membrane 7 and the bottom wall of the shell part 3". If the shell part 3" is compressed while the cap 24 is not on the spout 4', the contents of the compartment in the part 3" could be discharged accidentally if it were not for the presence of a conical plug 20 on the frame. The liquid takes the light piercing assembly along until the plug 20 obstructs the bore of the spout 4'. After piercing of the membrane 7 by the cutting blade 12', the lugs 16 engage a shoulder of the extension 19 in the compartment of the shell part 2" and prevent the plug 20 from reaching the spout 4'.

The containers of the invention have been found useful for storing two components which need to be mixed in precise proportions immediately prior to use, and whose mixtures have a very short shelf life, such as certain hair dyeing compositions requiring an addition of hydrogen peroxide solution, or adhesives based on epoxide resins and hardeners for the same. In charging the containers of the invention shown in FIGS. 3 and 4 with such a two-component composition, one of the cup-shaped shell parts is filled with one component, and its open side is closed by means of an aluminum foil coated with a thermoplastic resin and heat-sealed to the rim portion of the shell part. The edge portion of the foil is then draped over the outer face of the rim portion into a tubular shape, and the covered rim portion is inserted into the flange portion of the other shell part filled with the second component. The rim and flange portions are then sealed to each other and to the interposed aluminum foil by induction heating.

It should be understood, of course, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

What is claimed is:

1. A container for separately packaging two substances and for enabling mixing of said substances prior to dispensing thereof from said container comprising: means defining a first and a second compartment for storing a first and a second of said substances, respectively; frangible seal means interposed between said first and second compartments for enabling separate storage of substances contained therein; means for enabling discharge from at least one of said compartments of a mixture of said substances; and puncturing means for severing said frangible seal means to effect mixing of said substances; said puncturing means being structured as a framework composed of generally slender frame members forming said puncturing means with a basket-like configuration including a sharp knife edge at one end thereof; said puncturing means being loosely contained within one of said compartments with said knife edge adjacent said frangible seal means to effect severing of said frangible seal means upon application of a force against said puncturing means driving said puncturing means with said knife edge against said frangible seal means; said puncturing means being configured to drop through said severed frangible seal means from said one compartment into the other of said compartments and to enhance mixing of said substances when said container is agitated; said framework of said puncturing means comprising a pair of end frame sections formed from rod-like members arranged to define each of said end sections with a generally polygonal peripheral shape and elongated support struts extending between said end frame sections, said knife edge being formed on one of said end frame sections.

2. A container for separately packaging two substances and for enabling mixing of said substances prior to dispensing thereof from said container comprising: means defining a first and a second compartment for storing a first and a second of said substances, respectively; frangible seal means interposed between said first and second compartments for enabling separate storage of substances contained therein; means for enabling discharge from at least one of said compartments of a mixture of said substances; and puncturing means for severing said frangible seal means to effect mixing of said substances; said puncturing means being structured as a generally open framework composed of relatively slender frame members forming said puncturing means with a pair of end frame sections and elongate support struts extending between said end frame sections, with a knife edge being formed on one of said end frame sections; said puncturing means being loosely contained within one of said compartments with said knife edge adjacent said frangible seal means to effect severing of said frangible seal means upon application of a force against said puncturing means driving said puncturing means with said knife edge against said frangible seal means; said puncturing means being configured to drop through said severed frangible seal means from said one compartment into the other of said compartments and to enhance mixing of said substances when said container is agitated.

3. A container according to claims 1 or 2 wherein said knife edge is formed with a discontinuous configuration to effect severing of said frangible seal means by forming a portion thereof as a cutaway flap maintained joined with said seal means.

* * * * *